US005090074A

United States Patent [19]

Scales et al.

[11] Patent Number: 5,090,074

[45] Date of Patent: Feb. 25, 1992

[54] SUPPORT APPLIANCES

[76] Inventors: John T. Scales, 17, Brockley Avenue, Stanmore, Middlesex, HA7 4LX, HA7 4LX; John Barton, 16 Cobbetts Way, Wilmslow, Fulshaw Park, Cheshire, SK9 6HN, both of England, SK9 6HN

[21] Appl. No.: 580,838

[22] Filed: Sep. 11, 1990

[30] Foreign Application Priority Data

Sep. 12, 1989 [GB] United Kingdom ..... 8922059

[51] Int. Cl.[5] ..... A47C 27/14

[52] U.S. Cl. ..... 5/448; 5/468; 5/470; 5/473; 5/500

[58] Field of Search ..... 5/448, 468–470, 5/473, 481, 499, 500

[56] References Cited

U.S. PATENT DOCUMENTS 4,035,853 7/1977 Platter ..... 5/481
4,057,861 11/1977 Howorth ..... 5/468
4,185,341 1/1980 Scales ..... 5/468 X
4,317,244 3/1982 Balfour-Ritchie ..... 5/470 X
4,706,313 11/1987 Murphy ..... 5/473 X
4,914,772 4/1990 Difloe ..... 5/468 X

FOREIGN PATENT DOCUMENTS 2012159 7/1977 United Kingdom ..... 5/500

*Primary Examiner*—Michael F. Trettel
*Attorney, Agent, or Firm*—Klarquist, Sparkman, Campbell, Leigh & Whinston

[57] ABSTRACT

A medical mattress and mattress cover are disclosed, the mattress cover comprising a vapor-permeable support portion and discharge portion. Preferably the permeability coefficient of the discharge portion is much greater than that of the support portion so that water vapor passing into the cover from a user is discharged, the user and mattress remaining substantially dry. Each vapor-permeable portion may comprise a vapor permeable film supported on a textile fabric. In a second embodiment the mattress is provided with bearers defining passageways and the cover has means for passing a flow of air through the cover. This embodiment is suitable for use on an impermeable mattress support.

24 Claims, 1 Drawing Sheet

SUPPORT APPLIANCES

Figure 1:
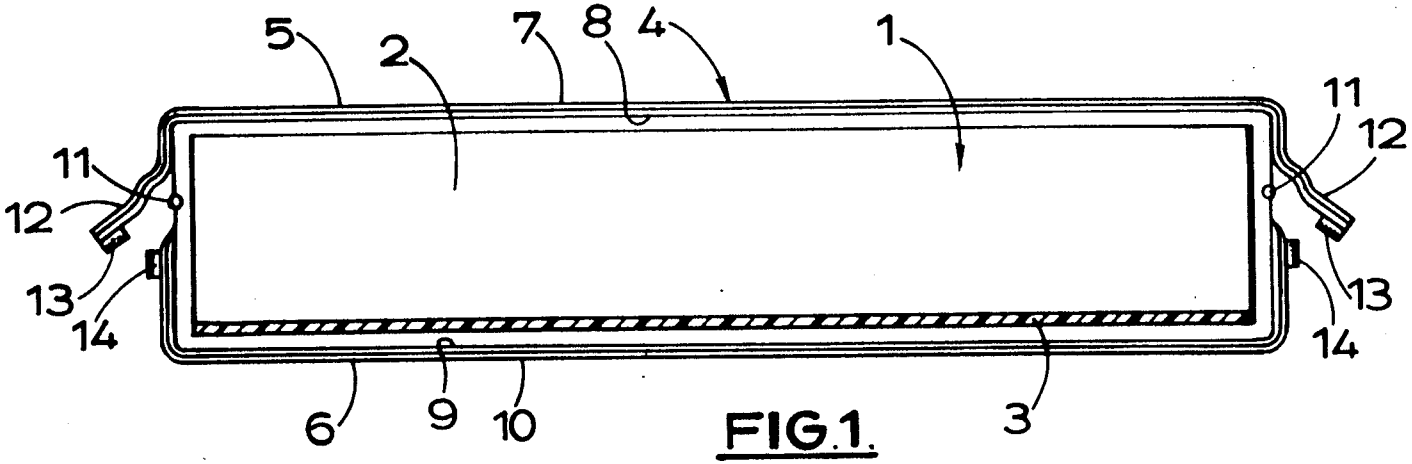

This invention relates to support appliances. Such support appliances include mattresses, pillows and cushions.

It is known to provide a support appliance comprising a support body made of a resilient foam material having interconnecting cells so that air or other gases and vapours can pass through it. It is also known to provide a cover for such a body, the cover comprising a flexible film of material that is permeable to water vapour. Throughout this description a material is described as being vapour-permeable if it has the property of being impermeable to air and impermeable to liquid water, even in the form of globules or fine drops, but permitting the passage therethrough of water vapour, either by a mechanism that is entirely chemical, that is to say a method that operates on a molecular level, or by a mechanism that is physico-chemical, that is to say a method that involves the physical passage of individual water molecules or small groups of water molecules through the material. Certain types of polyurethane films are vapour-permeable and have been used as covers for support bodies. The presence of a vapour-permeable cover between the user and the support body acts as a barrier and prevents the passage of liquids and bacteria into the support body. Nevertheless, water vapour can pass through the cover, and this can prevent a build up of water between the user's skin and the cover, thereby reducing the likelihood of the onset of conditions damaging to the skin.

The extent to which any material is vapour-permeable may be specified by what will for convenience by referred to herein as a permeability coefficient, a material having a permeability coefficient of x being such that it permits the passage of water vapour at a rate of x grams per square meter of material per twenty four hours at 37° C. and with a relative humidity of substantially 100% across the film (i.e. approximately 0% on one side of the film and approximately 100% on the other side of the film), the measurement being taken by the Payne's cup method, described in: Payne H.S. The permeability and structure of films. *Off Dig Fed Paint Varnish Production Clubs* 1936; 8: 297–304.

While the use of a vapour-permeable cover can lead to the removal of excess water from the user's skin, it may also lead to the presence of water vapour inside the support body. If part of the support body is not covered, some of the water vapour may well be driven from the support body in response to repeated compression and relaxation of the body that occurs in response to movement of the user. It is sometimes considered, however, that it is undesirable for part of the support body to be uncovered. In that case, water vapour has been removed by a current of air forced through suitable inlet and outlet ducts.

An aim of the present invention is to provide a system enabling a support body to be enclosed within a cover but makes it possible, at least in some circumstances, to dispense with the provision of means to force air through the body. Moreover the invention provides a system that is capable of use when the support body is not entirely enclosed and that can be advantageous in use.

From a first aspect the present invention consists in a support appliance comprising a resilient and gas permeable support body and a cover, said cover enclosing said support body and comprising a support portion and a discharge portion, said support portion comprising a first area of a first vapour-permeable substance said first vapour-permeable substance having a first permeability coefficient, said discharge portion comprising a second area of a second vapour-permeable substance, said second substance having a second permeability coefficient, said first and second areas and said first and second substances being such that a product of said second area and said second permeability coefficient is greater than a product of said first area and said first permeability coefficient.

The support appliance is capable of operating in the following manner. The appliance is disposed in a position of use in which the discharge portion is accessible to the ambient atmosphere. Water vapour passes from the neighbourhood of the user through the support portion of the cover, in a known manner, the rate of passage being determined by the permeability coefficient of the material from which the support portion is made. At the same time, however, water vapour can leave the interior of the cover through the discharge portion. Preferably the permeability coefficient of the discharge portion is greater than that of the support portion, so there is a tendency for the interior of the cover to remain relatively dry. If the appliance is such that air is able to leave and enter the appliance in response to a user's movements, some of the water vapour may be discharged from the appliance and may later be replaced by less humid air. Nevertheless, the provision of a discharge portion of a kind characteristic of the present invention can further assist in reducing the humidity within the appliance.

The successful operation of the support appliance in this way depends on the fact that the relative humidity outside the cover immediately adjacent to the user and to the support portion of the cover tends to be greater than the relative humidity inside the cover, immediately adjacent to the support portion. There is therefore a flow of water vapour into the support body. The moist air in the support body is circulated inside the support body as the result of the movement of the user and in this way comes into contact with the discharge portion. It is likely that the relative humidity of the moist air inside the support body will exceed the relative humidity of the ambient air outside the cover, immediately adjacent to the discharge portion, so that the moisture will pass out of the cover through the discharge portion. Moreover, as the permeability coefficient of the discharge portion is greater than that of the support portion the build up of high moisture levels in the support body is rendered very unlikely.

From a second aspect the present invention consists in a cover having an inner side and an outer side and adapted to enclose largely or completely a resilient and gas permeable support body, said cover comprising a support portion and a discharge portion, said support portion comprising a first area of a first vapour-permeable substance, said first vapour-permeable substance having a first permeability coefficient, said discharge portion comprising a second area of a second vapour-permeable substance, said second substance having a second permeability coefficient, said first and second areas and said first and second substances being such that a product of said second area and said second permeability coefficient is greater than a product of said first area and said first permeability coefficient.

The product of the area of the discharge portion and the permeability coefficient of the discharge portion is greater than the product of the area of the support portion and the permeability of the support portion so that in the unlikely event of the entire area of the support portion being subjected to water vapour at a relatively high temperature and a relatively high relative humidity, there would still remain a tendency for the interior of the cover to remain dry.

The permeability coefficient of the support portion is preferably no less than 230, and is preferably greater than that. It may, for example, be between 1000 and 1500. The permeability coefficient of the discharge portion is preferably considerably greater than that of the support portion and may, for example, be between 3000 and 3500.

The support portion of the cover would normally be constituted by a single, uninterupted area of the cover. Nevertheless, if desired, the support portion could comprise two or more separate areas. Likewise the discharge portion would normally be constituted by a single, uninterupted area of the cover but could comprise two or more separate areas.

The cover is preferably capable of being opened and closed at will for the purpose of allowing a support body to be placed inside it or removed from inside it. In one convenient arrangement the cover is formed with a longitudinally extensive opening, for that purpose, and a sliding clasp fastener by means of which the opening may be opened and closed at will. The fastener may be such that when fastened it is air-tight or substantially so. Alternatively the fastener may be such that when fastened it does allow the passage of air into and out of the appliance in response to a user's movements. A longitudinally extensive, waterproof flap may be provided to protect the fastener, an upper edge of the flap being integral with or permanently secured to the remainder of the cover in a waterproof manner. A lower part of the flap may be releasably attachable to part of the remainder of the cover below the fastener; this may be effected by means of strips of fabric with interengaging hooks and loops of the kind marketed under the registered trade mark Velcro.

The cover may comprise an upper portion and a lower portion which are joined together or are capable of being joined together along a zone extending around those portions and at or adjacent to the peripheries of those portions. The upper portion may comprise a support portion and a lower portion may comprise a discharge portion.

The support portion may be resiliently stretchable in one direction and is preferably resiliently stretchable in two directions at right angles to each other. In this way it can conform to the shape of the support body when the user's own weight is applied to it. The support portion may comprise a sheet or film of vapour-permeable material. The sheet or film may be unsupported; alternatively the sheet or film may be attached to a sheet of textile fabric. The sheet of textile fabric is preferably on the inside of the cover (so that it is closer to the support body than is the sheet or film of vapour-permeable material). The textile fabric preferably has flame-retardant properties; they may be inherent in the fabric or the result of treatment.

Generally there is no need for the discharge portion to be stretchable although it may be stretchable if desired. On the other hand it is generally desirable for the discharge portion to comprise a sheet or film of vapour-permeable material which is attached to a sheet of textile fabric. The fabric may be a non-stretch fabric. The sheet or film of vapour-permeable material is preferably on the inside of the cover so that the textile fabric is accessible from outside the cover when the cover is in use. The textile fabric may have flame-retardant properties. Alternatively, or in addition, the cover may be used with a support body provided with a flame-retardant textile material covering at least a part of the surface thereof that is adjacent to the discharge portion.

It is preferred for the support portion, or at least a part thereof, to face upwards when the cover is in use, and for the discharge portion, or at least a part thereof, to face downwards when the cover is in use. The support appliance may itself be supported on the generally horizontal surface of a base. The surface of the base may be of open-work form so as not to obstruct the discharge portion to any great extent. If the surface of the base were impermeable, however, it might well prevent or restrict the passage of water vapour through the discharge portion of the cover. To overcome, or at least reduce that problem, the support appliance may be provided with supplementary ventilating means. That means may comprise spaced bearers projecting downwards below the support body, inside the cover, so as to leave passageways extending beneath the support body, and means in the cover for enabling a flow of air to be introduced into the cover from outside and to be expelled from the cover. There may, for example, be an inlet opening in the cover which opening is normally closed but which can open to permit the passage of air or other gas into the cover, and one or more outlet openings in the cover and which is or are normally closed by which can open to permit the escape of air or other gas from inside the cover. The inlet opening may be provided with a one-way valve, and likewise the outlet opening or each of the outlet openings may be provided with a one-way valve. The supplementary ventilating means may be used in conjunction with a pump, such as an electrically-driven pump, operative to blow air or some other gas through the interior of the cover. The arrangement would generally be such that the resultant pressure of air or other gas in the cover would be insufficient to inflate the support appliance. The bearers projecting downwards below the support body may also be made from a resilient, gas-permeable foam material. They may be integral with the support body or constitute part of a stand situated beneath the support body.

Figure 2:
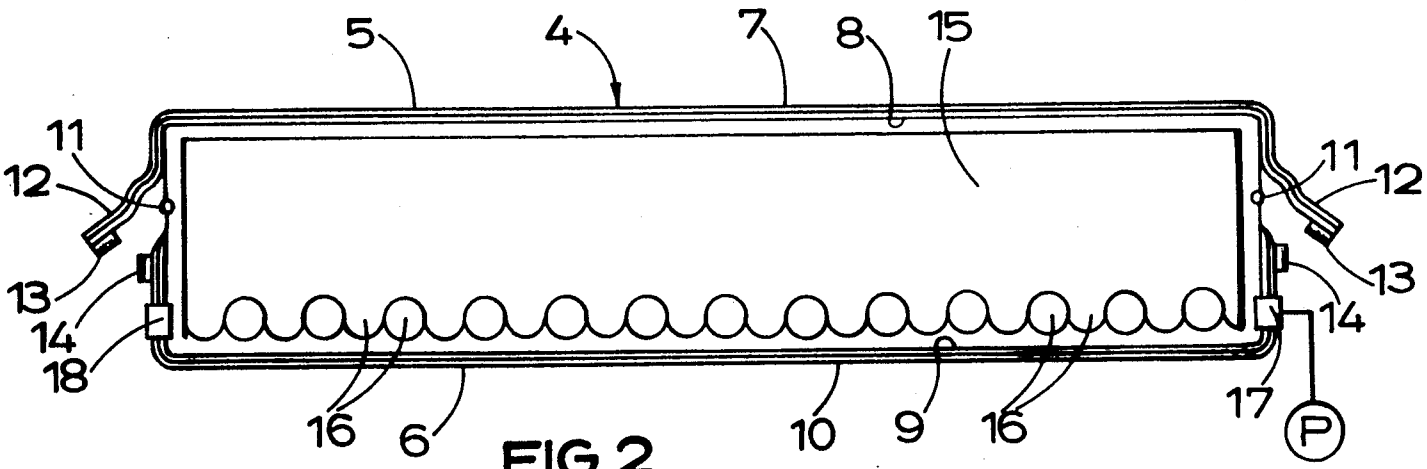

An embodiment of the invention will now be described in more detail, by way of example only, with reference to the accompanying drawings, in which:

FIG. 1 is a diagrammatic section through a support appliance, in the form of a mattress, embodying the present invention, and FIG. 2 is a diagrammatic section through a modified form of the mattress shown in FIG. 1.

The mattress shown in FIG. 1 comprises a support body 1 in the form of a rectangular block 2 of resilient, gas-permeable foam material which may conveniently be of a kind currently used in beds. If desired, however, the block 2 may be replaced by a support body of composite form; the body may, for example, resemble that described and illustrated in the specification of British patent No. 2 132 083 granted to Courtaulds PLC. A sheet 3 of flame-retardant textile material is secured to the underside of the block 2. The textile material, which may comprise a heavy twill, is also gas-permeable.

The support body 1 is contained within a cover 4 comprising an upper portion 5 and a lower portion 6. The upper portion 5 comprises a sheet 7 of vapour-permeable material (as herein defined) and a piece of textile material 8 attached to the undersurface of it. The vapour-permeable material may comprise a sheet of polyurethane material of the kind marketed under the trade mark Platilon, and having a permeability coefficient (as herein defined) of between 1000 and 1500. The material is resiliently stretchable in two directions at right angles to each other. The textile material 8 is also resiliently stretchable in two directions at right angles to each other and is also flame-retardant. It may comprise a knitted fabric. The lower portion 6 also comprises a sheet 9 of vapour-permeable material (as herein defined) and a piece of textile material 10 secured beneath it. The vapour-permeable material 9 may comprise a sheet of polyurethane material of the kind marketed under the trade mark Platilon or of the kind marketed under the trade mark Sympatex. It has a permeability coefficient (as herein defined) of between 3000 and 3500. The sheet 9 is dot-laminated to the textile material 10, which is a non-stretch material comprising woven nylon.

The upper and lower portions 5 and 6 of the cover are releasably joined together by a sliding-clasp fastener 11 which extends around the cover. The fastener is of a design such as to be air-tight or at least to afford considerable resistance to air through it when it is closed. Marginal parts of the upper portion 5 constitute a waterproof flap 12 which can protect the fastener 11. The lower edge of the flap can be releasably attached to the lower portion 6 of the cover, beneath the fastener 11, by means of strips of fabric 13 and 14 of the kind comprising interengaging hooks and loops; suitable fabric is marketed under the registered trade mark Velcro.

That part of the upper portion 5 of the cover that is above the fastener 11 constitutes a support portion of the cover, while the lower portion 6 of the cover constitutes a discharge portion. The areas of the support portion and the discharge portion are approximately the same as each other so that the product of the area of the discharge portion and its permeability coefficient is considerably greater, perhaps two or three times greater, than the product of the area of the support portion and its permeability coefficient.

In use the mattress may be placed on a base of openwork construction supported above floor level so that air can readily circulate beneath and is contact with the lower portion 6 of the cover. In use, when a user lies on the mattress, water vapour passes through the support portion of the cover but is discharged again through the discharge portion, as described above.

A modified construction is illustrated in FIG. 2; components similar to those illustrated in FIG. 1 have the same reference numerals as the corresponding components shown in FIG. 1. The mattress shown in FIG. 2 includes a support body 15 comprising a rectangular block of resilient, gas-permeable foam material generally similar to the block 1 but provided with integral bearers 16 projecting downwards from it. The bearers are shaped as inverted domes and are disposed at the corners of a notional grid or array of squares, the sides of which are at 45° to the sides and ends of the body. There is no sheet of flame-retardant material corresponding to the sheet of material 3, but the textile fabric 10 is flame-retardant.

In one end wall of the cover there is mounted a one-way inlet valve 17 which is normally closed but which can open to allow air to flow into the cover when air under pressure is applied to the outer end of the valve. A one-way outlet valve 18 is mounted in the other end wall of the cover, the valve being normally closed but opening, in response to a pressure-differential across it, to allow air to flow out form the interior of the cover.

The mattress shown in FIG. 2 may be used in exactly the same way as the mattress shown in FIG. 1. Unlike the mattress of FIG. 1, however, it can also be used when placed on a flat base that is impermeable to air and which prevents water vapour being discharged at an adequate rate through the discharge portion. Thus the mattress of FIG. 2 can be placed on an impermeable base and air under pressure can be introduced into it through the inlet valve 17. The pressurised air can be derived from an electrically-driven pump P. Air from within the cover flows readily between the bearers 16 and is discharged into the atmosphere through the outlet valve 18.

We claim:

1. A cover having an inner side and an outer side and adapted to enclose largely or completely a resilient and gas permeable support body, said cover comprising a support portion and a discharge portion each of said support portion and said discharge portion being formed from a vapor-permeable material which is impermeable to air and liquid water but permits the passage of water vapor, said support portion comprising a first area of a first vapour-permeable material, said first vapour-permeable material having a first permeability coefficient, said discharge portion comprising a second area of a second vapor-permeable material, said second material having a second permeability coefficient, said first and second areas and said first and second materials being such that a product of said second area and said permeability coefficient is greater than a product of said first area and said first permeability coefficient.

2. A cover according to claim 1 in which said second permeability coefficient is greater than said first permeability coefficient.

3. A cover according to claim 1 in which said first permeability coefficient is greater than 230.

4. A cover according to claim 1 in which said first permeability coefficient is between 1000 and 1500.

5. A cover according to claim 1 in which the second permeability coefficient is between 3000 and 3500.

6. A cover according to claim 1 in which said first and said second areas each consist of a single uninterrupted surface.

7. A cover according to claim 1 in which said cover has means defining a longitudinal opening having an open position and a closed position, said opening enabling the support body to be placed inside and removed from said cover in said open position, and said opening being substantially airtight in said closed position.

8. A cover according to claim 1 in which said cover comprises an upper support portion having a first periphery, upper closure means joined to said first periphery, a lower discharge portion defining a second periphery, lower closure means joined to said second periphery, said upper closure means being adapted to releasably engage said lower closure means to join said upper support portion to said lower discharge portion along said first and said second peripheries.

9. A cover according to claim 1 in which said support portion and said discharge portion each comprise a sheet of textile fabric supporting a vapour-permeable film.

10. A cover according to claim 9 in which in said support portion said textile fabric is on said inner side of said cover and said vapour-permeable film is on said outer side.

11. A support appliance comprising a resilient and gas permeable support body and a cover, said cover enclosing said support body and comprising a support portion and a discharge portion each of said support portion and said discharge portion being formed from a vapour-permeable material which is impermeable to air and liquid water but permits the passage of water vapor, said support portion comprising a first area of a first vapor permeable material, said first vapor-permeable material having a first permeability coefficient, said discharge portion comprising a second area of a second vapor-permeable material, said second material having a second permeability coefficient, said first and second areas and said first and second materials being such that a product of said second area and said second permeability coefficient is greater than a product of said first area and said first permeability coefficient.

12. A support body according to claim 11 in which said support body is provided with spaced bearing means projecting downwardly from said support body, said bearing means defining passageways beneath said support body.

13. A support body according to claim 11 in which said cover is provided with air inlet means and air outlet means, said inlet means being adapted to be connected to a pump, such that air introduced through said inlet means flows through said passageways and is expelled through said outlet means.

14. A support body according to claim 11 in which said second permeability coefficient is greater than said first permeability coefficient.

15. A support body according to claim 11 in which said first permeability coefficient is greater than 230.

16. A support body according to claim 11 in which said first permeability coefficient is between 1000 and 1500.

17. A support body according to claim 11 in which the second permeability coefficient is between 3000 and 3500.

18. A support body according to claim 11 in which said first and said second areas each consist of a single uninterrupted surface.

19. A support body according to claim 11 in which said cover has means defining a longitudinal opening having an open position and a closed position, said opening enabling the support body to be placed inside and removed from said cover in said open position, and said opening being substantially airtight in said closed position.

20. A support body according to claim 11 in which said cover comprises an upper support portion having a first periphery, upper closure means joined to said first periphery, a lower discharge portion defining a second periphery, lower closure means joined to said second periphery, said upper closure means being adapted to releasably engage said lower closure means to join said upper support portion to said lower discharge portion along said first and said second peripheries.

21. A support body according to claim 11 in which said support portion and said discharge portion each comprise a sheet of textile fabric supporting a vapour-permeable film.

22. A support body according to claim 21 in which in said support portion said textile fabric is on said inner side of said cover and said vapour-permeable film is on said outer side.

23. A cover having an inner side and an outer side and adapted to enclose largely or completely a resilient and gas permeable support body, said cover comprising a support portion and a discharge portion, said support portion comprising a first area of a first vapour-permeable substance, said first vapour-permeable substance having a first permeability coefficient, said discharge portion comprising a second area of a second vapour-permeable substance, said second substance having a second permeability coefficient, said first and second areas and said first and second substances being such that a product of said second area and said second permeability coefficient is greater than a product of said first area and said first permeability coefficient, said support and discharge portions each comprising a sheet of textile fabric supporting a vapour-permeable film.

24. A support appliance comprising a resilient and gas permeable support body and a cover enclosing said support body, said cover comprising a support portion and a discharge portion, said support portion comprising a first area of a first vapor-permeable substance, said first vapor-permeable substance having a first permeability coefficient, said discharge portion comprising a second area of a second vapor-permeable substance, said second substance having a second permeability coefficient, said first and second areas and said first and second substances being such that a product of said second area and said second permeability coefficient is greater than a product of said first area and said first permeability coefficient, said support portion and said discharge each comprising a sheet of textile fabric supporting a vapour-permeable film.

* * * * *